US006176761B1

(12) United States Patent
Underhill

(10) Patent No.: US 6,176,761 B1
(45) Date of Patent: Jan. 23, 2001

(54) SPORTS BRA WITH STORAGE POUCH

(76) Inventor: Annette K. Underhill, P.O. Box 600, Russellville, AR (US) 72811

( * ) Notice: Under 35 U.S.C. 154(b), the term of this patent shall be extended for 0 days.

(21) Appl. No.: 09/520,777

(22) Filed: Mar. 8, 2000

(51) Int. Cl.[7] ..... A41C 3/00
(52) U.S. Cl. ..... 450/89; 450/1
(58) Field of Search ..... 450/1, 65, 66, 450/67, 70, 89; 2/247.25, 1

(56) References Cited

U.S. PATENT DOCUMENTS

| | | |
|---|---|---|
| D. 241,189 | 8/1976 | Clark . |
| 2,492,862 | 12/1949 | Harvey . |
| 2,503,847 | 4/1950 | Shanahan . |
| 2,593,711 | 4/1952 | Weatherly . |
| 2,624,881 | 1/1953 | Lee . |
| 3,078,852 | 2/1963 | Stapleton . |
| 4,815,510 | 3/1989 | Edelist . |
| 5,067,178 | 11/1991 | Katchka . |
| 5,496,205 | 3/1996 | Lee . |
| 5,573,441 | 11/1996 | Smith . |

*Primary Examiner*—Gloria M. Hale

(74) *Attorney, Agent, or Firm*—Frank J. Catalano

(57) ABSTRACT

A sports bra has a pair of cups joined by a cleavage portion between the proximate edges of the cups and a back strap portion between the distal edges of the cups. The cups and cleavage portion are made of cloth having substantially universal elasticity so as to provide adequate support. A rectangular panel made of cloth having substantially universal elasticity is fastened along its bottom and side edges to an inside wall of the cleavage portion of the bra to form a storage pouch of approximately credit card dimensions. A plurality of short hook and loop segments extending substantially fully across the upper inside edge of the panel with mating segments of hook and loop material oppositely fixed along the inside wall of the cleavage portion of the bra allows the pouch to be completely sealed while still affording the desired universal elasticity. Preferably, the panel is made of back-to-back pieces of cloth with the inner one being non-absorbent and the cleavage portion is also made of back-to-back pieces of cloth with the inner one being non-absorbent so as to allow the sports bra to be fully absorbent along its body contact surfaces and yet provide a no-absorbent storage pouch to protect its contents. A flat member may be disposed between the panel cloths to stiffen the storage pouch.

16 Claims, 3 Drawing Sheets

SPORTS BRA WITH STORAGE POUCH

BACKGROUND OF THE INVENTION

This invention relates generally to clothing and more particularly concerns women's undergarments.

The inclusion in the structure of a bra of concealed pouches for storing various types of articles is known. Some bras have storage cases attached externally to the cups. Such devices are generally conspicuous and disruptive of the figure line. They also can be a source of embarrassment if access is necessary in a public place. Others provide one or more compartments accessible from the inside of one or both of the cups. This design can be more aesthetically appealing but is less comfortable and less accessible and does not resolve the embarrassment problem for the wearer. Still others fix a zippered compartment to the inside of the bra across the inside portions of the cups and the cleavage area. This improves aesthetics and accessibility but, because the inelasticity of the compartment at its zipper closure and along the fixed seam between the compartment and the bra renders a significant portion of the entire garment inelastic, the bra is uncomfortable and not well suited to its purpose. Other bras contour an accessible pocket to portions of the bra other than the cups. Such pockets afford little usable storage space unless they add undesirable extensions to the bra which would otherwise be unnecessary. Bras of this type also require vertically aligned closures because of space limitations, but vertical closures make the contents most inaccessible. Finally, bras generally are made of nonabsorbent material while sports bras are made of material which will readily absorb perspiration. However, no known bra combines absorbent body contacting surfaces in combination with a non-absorbent wall protecting the contents of a storage pouch.

It is, therefore, an object of this invention to provide a bra with a storage pouch which does not significantly alter the universal elasticity of the bra. Another object of this invention is to provide a bra with a storage pouch having a stretchable closure. A further object of this invention is to provide a bra with a storage pouch which does not use a zipper. Yet another object of this invention is to provide a bra with a storage pouch which is easily accessible from inside the bra through an upper horizontal opening. It is also an object of this invention to provide a bra with a storage pouch which does not require the otherwise unnecessary addition of extensions to the bra structure. Still another object of this invention is to provide a bra with a storage pouch which is concealed, yet comfortable. An additional object of this invention is to provide a perspiration absorbent bra with a storage pouch which protects its contents from damage due to moisture.

SUMMARY OF THE INVENTION

In accordance with the invention, a sports bra has a pair of cups joined by a cleavage portion between the proximate edges of the cups and a back strap portion between the distal edges of the cups. The cups and cleavage portion are made of cloth having substantially universal elasticity so as to provide adequate support. A rectangular panel made of cloth having substantially universal elasticity is fastened along its bottom and side edges to an inside wall of the cleavage portion of the bra to form a storage pouch of approximately credit card dimensions.

At least one relatively short segment of hook and loop material is fixed along an upper inside edge of the panel and at least one mating segment of hook and loop material is oppositely fixed along the inside wall of the cleavage portion of the bra. Thus, the pouch can be sealed without losing the universal elasticity of the garment. A plurality of short hook and loop segments extending substantially fully across the upper inside edge of the panel allows the pouch to be completely sealed while still affording the desired elasticity.

The panel is preferably lengthwise vertically aligned for maximum comfort and may be upwardly extended to conform its upper edge to the contour of the upper edge of the cleavage portion of the bra. The panel bottom edge is preferably closely coincident with a bottom edge of the cleavage portion of the bra. It is preferred that the panel be made of non-absorbent cloth or a pair of back-to-back pieces of cloth with the inner one being non-absorbent. A flat member can be disposed between the cloth segments to stiffen the storage pouch. Similarly, the cleavage portion may consist of back-to-back pieces of cloth with the inner one being non-absorbent. Thus the sports bra can be fully absorbent along its body contact surfaces and yet provide a non-absorbent storage pouch to protect its contents.

Preferably, the back strap portion is made of cloth having substantially universal elasticity. The bra may also include a pair of shoulder straps, one extending from an upper edge of each of the cups to the back strap portion, preferably at approximately a midpoint of the back strap portion, to provide additional support. The shoulder straps are also preferably made of cloth having substantially universal elasticity.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
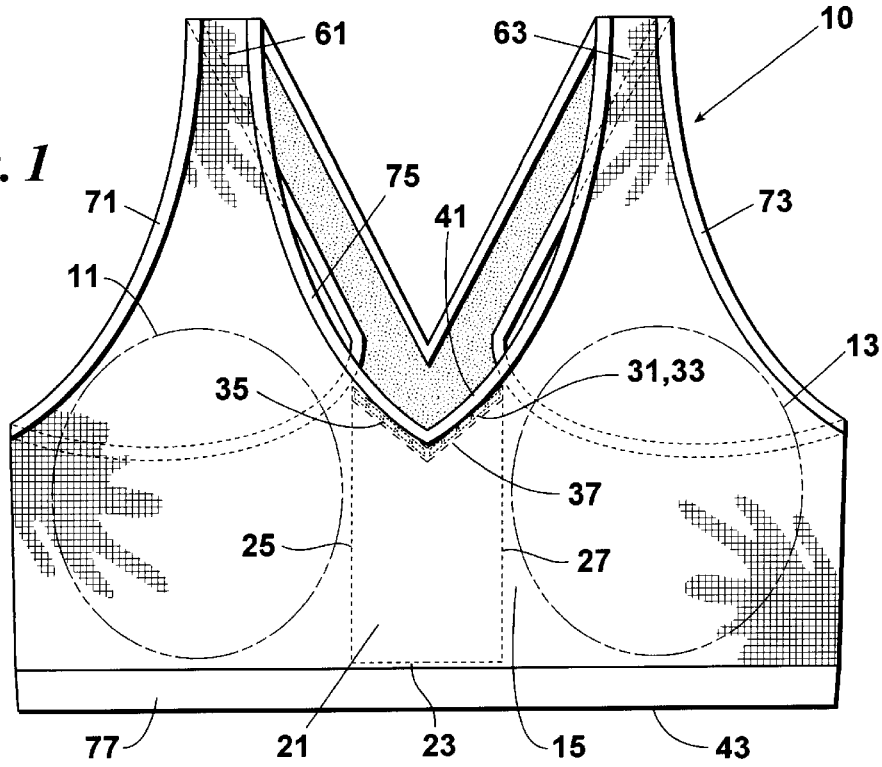
FIG. 1 is a front elevation view of the sports bra.
Figure 3:
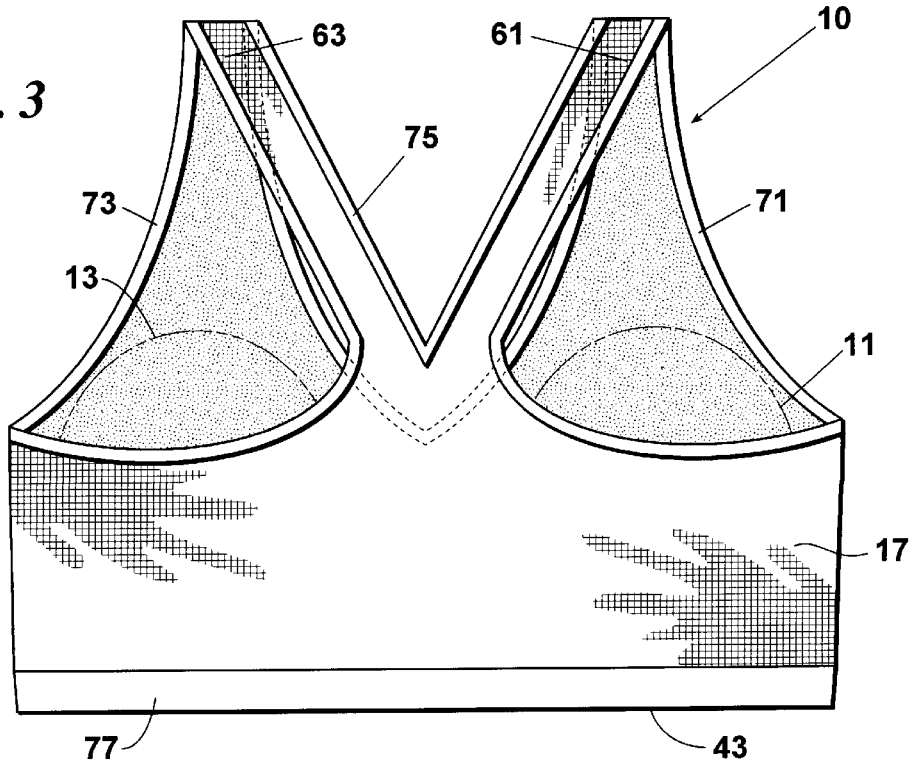
FIG. 3 is a rear elevation view of the sports bra.
Figure 2:
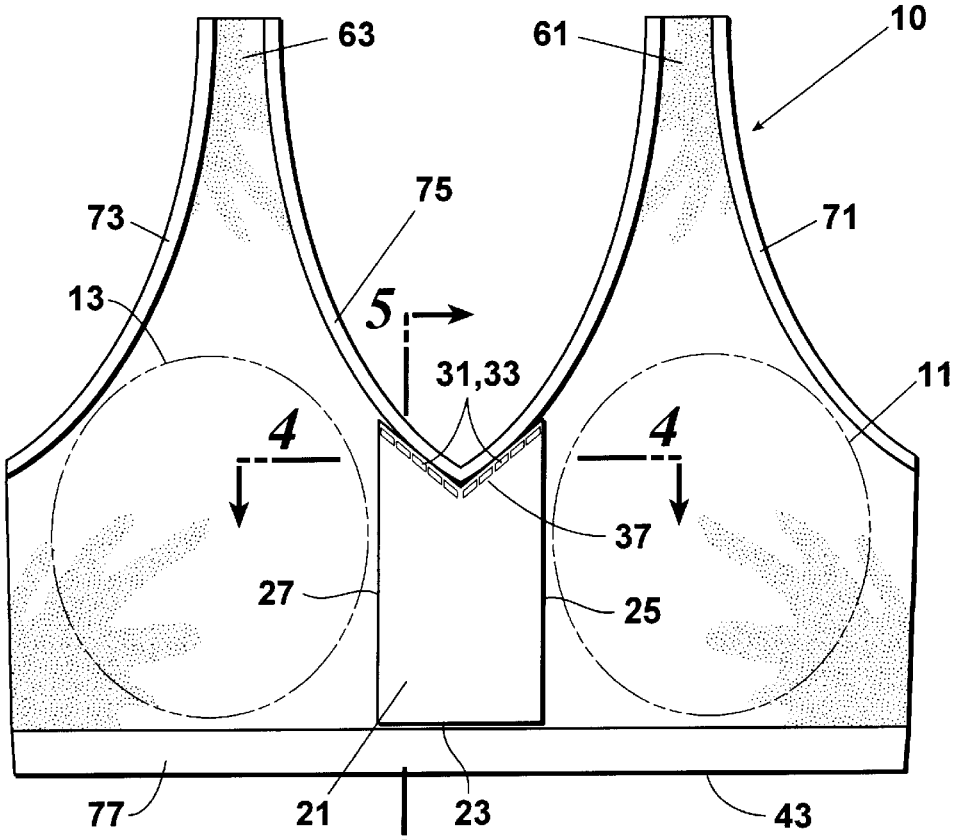
FIG. 2 is a rear elevation view of the cup portion of the sports bra.

Turning first to FIGS. 1–3, a sports bra 10 has a pair of cups 11 and 13 joined by a cleavage portion 15 between the proximate edges of the cups and a back strap portion 17 between the distal edges of the cups 11 and 13. The cups 11 and 13 and cleavage portion 15 are made of cloth having substantially universal elasticity so as to provide adequate support. A rectangular panel 21 made of cloth having substantially universal elasticity is fastened along its bottom 23 and side edges 25 and 27 to an inside wall of the cleavage portion 15 of the bra 10 to form a storage pouch of approximately credit card dimensions.

Figure 4:
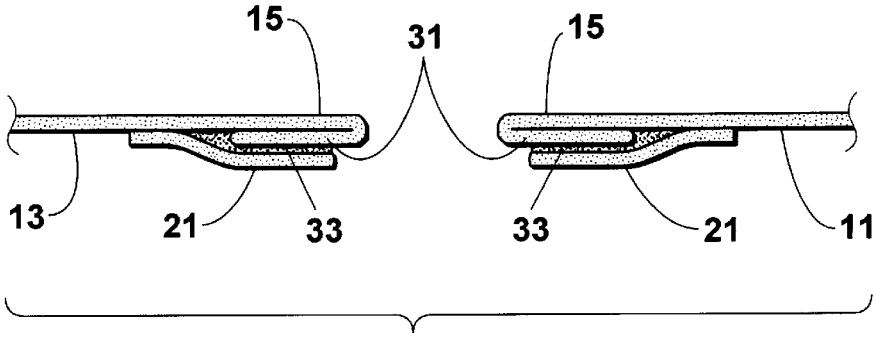
FIG. 4 is a cross-sectional view, taken along the line 4—4 of FIG. 2.
Figure 5:
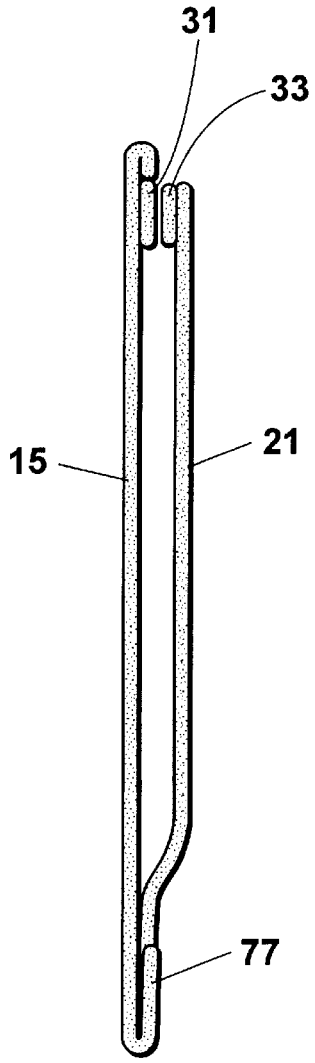
FIG. 5 is a cross-sectional view taken along the line 5—5 of FIG. 2.

As can best be seen in FIGS. 4 and 5, at least one relatively short segment 31 of hook and loop material is fixed along an upper inside edge of the panel 21 and at least one mating 33 segment of hook and loop material is oppositely fixed along the inside wall of the cleavage portion 15 of the bra 10. Thus, the pouch can be sealed without losing the universal elasticity of the garment. As is shown, a plurality of short hook and loop segments 31 and 33 extending substantially fully across the upper inside edge of the panel 21 allows the pouch to be completely sealed while still affording the desired elasticity.

Figure 6:
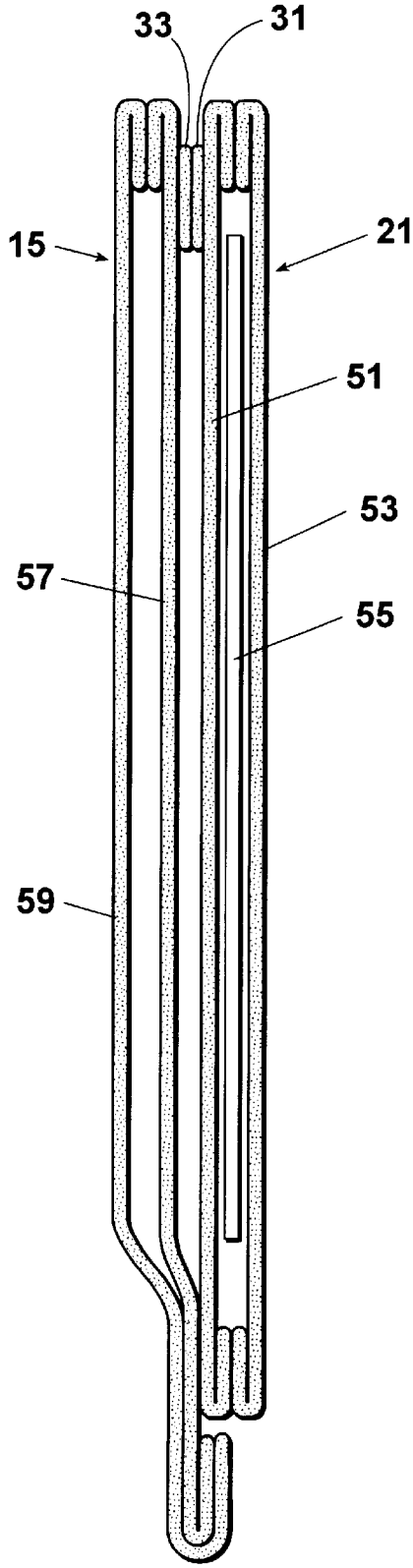
FIG. 6 is a vertical cross-sectional view of a preferred embodiment of the sports bra storage pouch.

The panel 21 is preferably lengthwise vertically aligned for maximum comfort and, as shown, may be upwardly extended 35 and 37 to conform its upper edge 39 to the contour of the upper edge 41 of the cleavage portion 15 of the bra 10. The panel bottom edge 23 is preferably closely coincident with a bottom edge 43 of the cleavage portion 15 of the bra 10. It is preferred that the panel 21 be made of non-absorbent cloth or, as shown in FIG. 6, a pair of back-to-back pieces of cloth 51 and 53 with the inner one 51 being non-absorbent. A flat member 55 can be disposed between the cloth segments 51 and 53 to stiffen the storage pouch. Similarly, the cleavage portion 15 may consist of back-o-back pieces of cloth 57 and 59 with the inner one 57 being non-absorbent. Thus, the sports bra 10 can be fully absorbent along its body contact surfaces and yet provide a non-absorbent storage pouch to protect its contents.

Preferably, the back strap portion 17 is made of cloth having substantially universal elasticity. The bra 10 may also include a pair of shoulder straps 61 and 63, one extending from an upper edge of each of the cups 11 and 13 to the back strap portion 17, preferably at approximately a midpoint of the back strap portion 17, to provide additional support. The shoulder straps 61 and 63 are also preferably made of cloth having substantially universal elasticity.

As shown, the arm edges 71 and 73, mesh edges 75 and wrist edge 77 of the bra 10 are folded and stitched to finish the garment. As is best seen in FIG. 6, similar finishing techniques can be applied to the edges of the panel 21 and the cleavage portion 15 of the bra 10.

Thus, it is apparent that there has been provided, in accordance with the invention, a sports bra with a storage pouch that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A sports bra comprising:

a pair of cups shaped to receive a woman's breasts, said cups being joined by a cleavage portion of the bra between proximate edges thereof and by a back strap portion of the bra between distal edges thereof, said cups and cleavage portion being made of cloth having substantially universal elasticity so as to support the woman's breasts; and a rectangular panel made of cloth having substantially universal elasticity fastened along bottom and side edges thereof to an inside wall of said cleavage portion of the bra to form a storage pouch of approximately credit card dimensions; and at least one relatively short segment of hook and loop material fixed along an upper inside edge of said panel and at least one mating segment of hook and loop material fixed along said inside wall of said cleavage section opposite a respective at least one segment.

2. A sports bra according to claim 2, said back strap portion being made of cloth having substantially universal elasticity.

3. A sports bra according to claim 2, said panel being lengthwise vertically aligned.

4. A sports bra according to claim 1 having a plurality of short hook and loop segments extending substantially fully across said upper inside edge of said panel.

5. A sports bra according to claim 1 further comprising a pair of shoulder straps, one extending from an upper edge of each of said cups to said back strap portion.

6. A sports bra according to claim 5, said shoulder straps extending to approximately a midpoint of said back strap portion.

7. A sports bra according to claim 5, said shoulder straps being made of cloth having substantially universal elasticity.

8. A sports bra according to claim 1, said panel being upwardly extended to conform an upper edge thereof to a contour of an upper edge of said cleavage portion.

9. A sports bra according to claim 1, said panel bottom edge being closely coincident with a bottom edge of said cleavage portion.

10. A sports bra according to claim 1, said panel being made of non-absorbent cloth.

11. A sports bra according to claim 1, said panel comprising a pair of back-to-back cloth segments.

12. A sports bra according to claim 11 further comprising a flat member disposed between said back-to-back cloth segments to stiffen said storage pouch.

13. A sports bra according to claim 11, an inner one of said back-to-back cloth segments being made of non-absorbent cloth.

14. A sports bra according to claim 13, each of said cups comprising a pair of back-to-back cloth segments.

15. A sports bra according to claim 1, said cleavage portion comprising a pair of back-to-back cloth segments.

16. A sports bra according to claim 15, an inner one of said back-to-back segments being made of non-absorbent cloth.

* * * * *